US007988516B2

(12) United States Patent
Bishop

(10) Patent No.: US 7,988,516 B2
(45) Date of Patent: Aug. 2, 2011

(54) CONSTRUCTION AND GAMING CUBES

(76) Inventor: Forrest Frederick Bishop, Seattle, WA (US)

( * ) Notice: Subject to any disclaimer, the term of this patent is extended or adjusted under 35 U.S.C. 154(b) by 1061 days.

(21) Appl. No.: 11/801,904

(22) Filed: May 11, 2007

(65) Prior Publication Data

US 2008/0280521 A1 Nov. 13, 2008

(51) Int. Cl.
*A63H 33/04* (2006.01)
*A63H 33/08* (2006.01)

(52) U.S. Cl. ..... 446/85; 446/108; 446/124; 446/127

(58) Field of Classification Search ..... 446/85, 446/108, 114–116, 120, 121, 124, 125, 127; 273/153 S, 160, 156, 153 R, 157 R; 220/4.01, 220/4.28, 4.31, 4.32, 666, 676
See application file for complete search history.

(56) References Cited

U.S. PATENT DOCUMENTS

| | | | | | |
|---|---|---|---|---|---|
| 2,020,562 | A * | 11/1935 | Miller | 446/127 |
| 3,327,882 | A * | 6/1967 | Andrews | 220/4.28 |
| 3,552,817 | A * | 1/1971 | Marcolongo | 312/107 |
| 3,722,971 | A * | 3/1973 | Zeischegg | 312/107 |
| 3,974,934 | A * | 8/1976 | Rohner | 220/4.28 |
| 4,345,762 | A * | 8/1982 | Lebelson | 273/157 R |
| 5,086,999 | A * | 2/1992 | Mullen | 244/159.4 |
| 5,267,863 | A * | 12/1993 | Simmons, Jr. | 434/96 |
| 5,549,198 | A * | 8/1996 | Thiele et al. | 206/307 |
| 5,664,387 | A * | 9/1997 | Bhatti | 52/604 |
| 5,775,046 | A * | 7/1998 | Fanger et al. | 52/590.1 |
| 5,826,873 | A * | 10/1998 | Lavermicocca | 273/157 R |
| 6,386,936 | B1 * | 5/2002 | Gebara | 446/117 |
| D506,790 | S * | 6/2005 | Gee | D21/479 |
| 2004/0102132 | A1 * | 5/2004 | Miller et al. | 446/125 |

FOREIGN PATENT DOCUMENTS

FR 2684959 A1 * 6/1993

* cited by examiner

*Primary Examiner* — Gene Kim
*Assistant Examiner* — Alyssa M Hylinski
(74) *Attorney, Agent, or Firm* — Mark S. Hubert

(57) ABSTRACT

This invention generally relates to a set of parallelepipedal bodies (cubes) capable of matingly compatible engagement for interconnection with substantially similar cubes or matingly conformed rails, so as to allow up to three degrees of freedom in the sliding movement of an individual cube or grouping of cubes about a grouping of other interconnected cells from the set. Each cube is constructed from six plates or from three plate pairs. The interior physical configuration of tabs and slots lends itself to injection molding of plates or plate pairs. The exterior physical configuration of all plates and at least one of the exterior surfaces of the rails are substantially similar. When a number of cubes are assembled into a cubic array, there can be slab movement, row movement or solo cube movement.

19 Claims, 21 Drawing Sheets

CONSTRUCTION AND GAMING CUBES

TECHNICAL FIELD

This invention generally relates to a set of cubes, or generally parallelepipedal bodies and matingly conformed rails, capable of sliding engagement so as to allow variable single cube movement and placements within an array of substantially similar cubes and or rails. These cubes form excellent building blocks for hand puzzles and structural construction sets as well as lending themselves to adaptation for a plethora of other uses such as storage containers.

BACKGROUND OF THE INVENTION

The present invention relates to a set of unique parallelepipedal cubes, capable of a hollow core construction. Each cube has six plates, the rear faces of which matingly interlock in a synergistic design for assembly. There are only two kinds of different plates used in the assembly of each cube. The exterior faces of the two plates are substantially similar in physical configuration and are rectangular, however the interior faces differ in the arrangement and number of tabs and slots used for the assembly of the cube. Six of the two plates, (three of each type), are used for the assembly of one cube. Additionally, the two plates may be formed as a single unit, (a plate pair) three identical plate pairs which still synergistically interlock for assembly to a cube. The design of the plates allow for injection molding of the two kinds of individual plates or of the plate pairs.

The rails are linear members bearing the same physical configuration as the exterior face of the plates on at least one of their surfaces. The rails may have more than five surfaces (as in the case of a triangular linear member), although the most common rail configuration has four sides and two ends (a rectangular linear member) and may or may not have sides of equal width. An "L" shapped rail is utilized for specific construction assemblies.

The exterior face design is such that all exterior faces matingly interlock for sliding engagement. In this manner the cubes are free to move about each other individually or in groupings, generally with three degrees of freedom. (I.E. movement is allowed in each of the X, Y and Z axis.) Similarly, a single cube or array of cubes may slidingly engage a rail.

The interlocking design on the backside of each face plate maximizes the amount of hollow interior space while providing for a rigid unibody design wherein the strength of the cell is a synergistic function of all six face plates. The ease of fabrication and plethora of applicable uses are some of this invention's stronger features.

When a multitude of cubes are assembled into an array, preferably cubic, there can be slab movement, row movement or solo cell movement.

Since the intended field of art for such an invention is personal gaming, this invention's design overcomes the drawbacks of the prior art in that it greatly simplifies the mass fabrication of the cubes as well as the ease of arranging a cube groupings about another cube or cube grouping. It also offers a level of difficulty and variety in hand puzzles that has heretofore not been seen.

SUMMARY OF THE INVENTION

In accordance with the invention, an object of the present invention is to provide an improved, enclosed hollow body cube, constructed with a minimum of generally planar plates.

It is another object of this invention to provide a cube for use in a portable puzzle where each of the cube's six faces can be cheaply and simply fabricated and assembled.

It is a further object of this invention to provide a set of enclosed body parallelepipedal cubes that is comprised of a single cube exterior face orientation yet still allowing each cube kinematic compatibility in up to three degrees of freedom.

It is still a further object of this invention to provide for a set of enclosed body parallelepipedal cubes and matingly conformed rails that allow sliding engagement for construction and commercial storage uses.

It is yet a further object of this invention to provide a hollow body parallelepipedal cube with a minimal of different components.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements. Other objects, features and aspects of the present invention are discussed in greater detail below.

DETAILED DESCRIPTION

Figure 1:
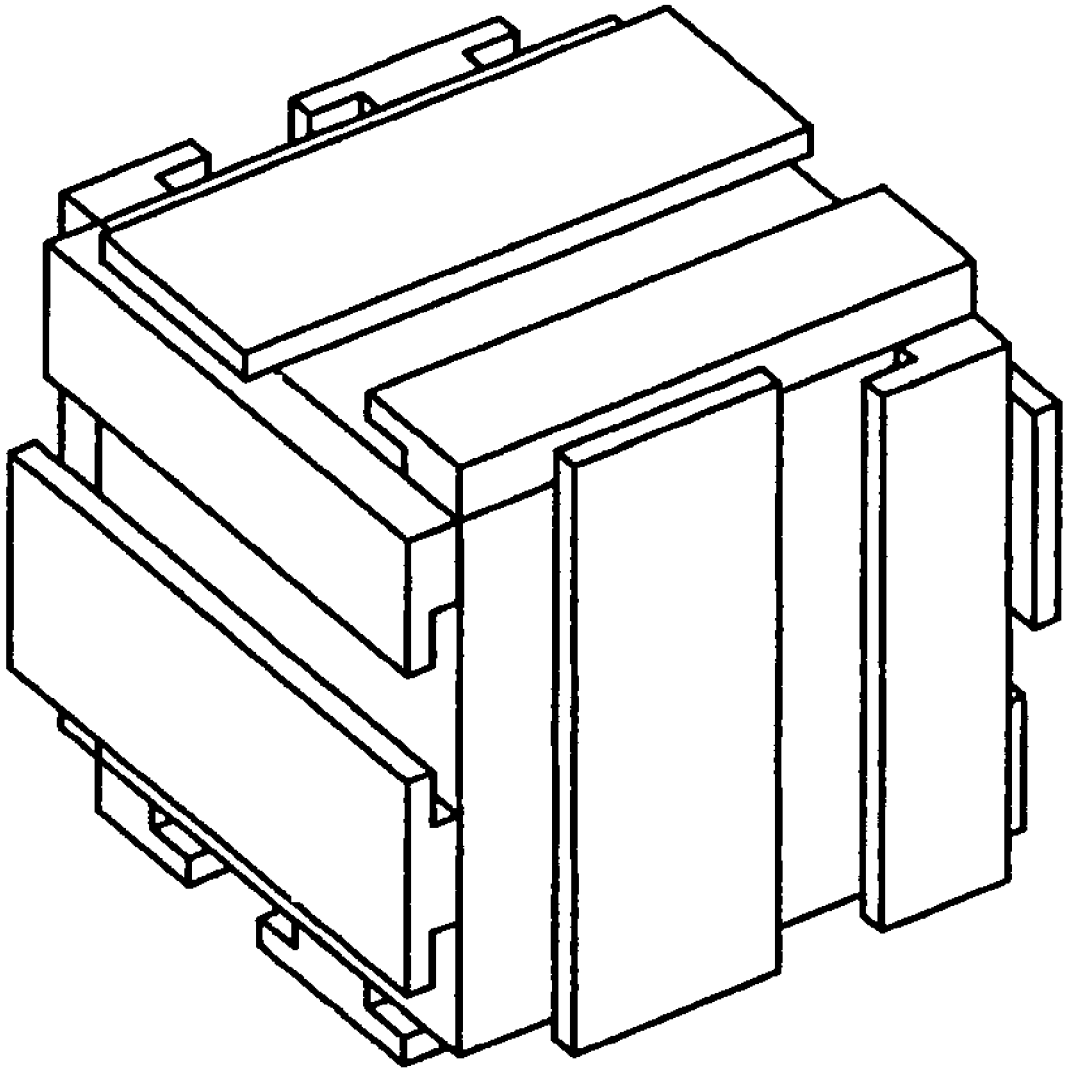
FIG. 1 is a perspective view of a cube.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

The above description will enable any person skilled in the art to make and use this invention. It also sets forth the best modes for carrying out this invention. There are numerous variations and modifications thereof that will also remain readily apparent to others skilled in the art, now that the general principles of the present invention have been disclosed.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

Figure 2:
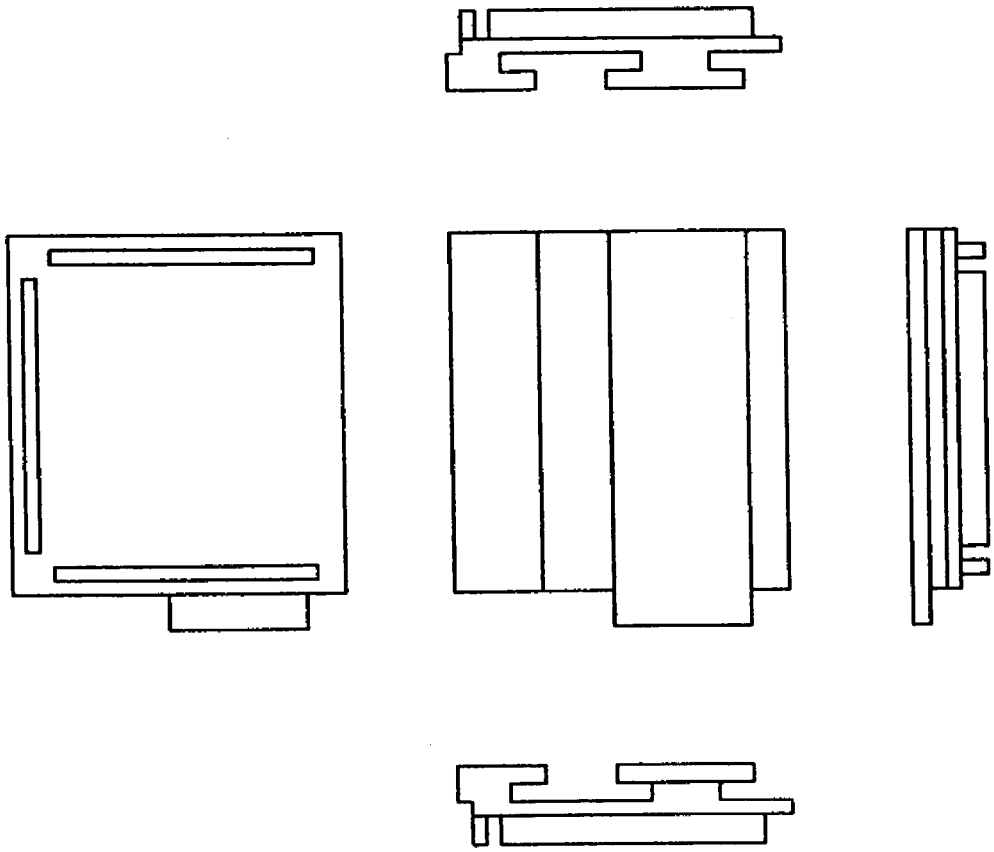
FIG. 2 is set of arranged drawings showing the first plate's exterior face, interior face, end view, and side view.
Figure 3:
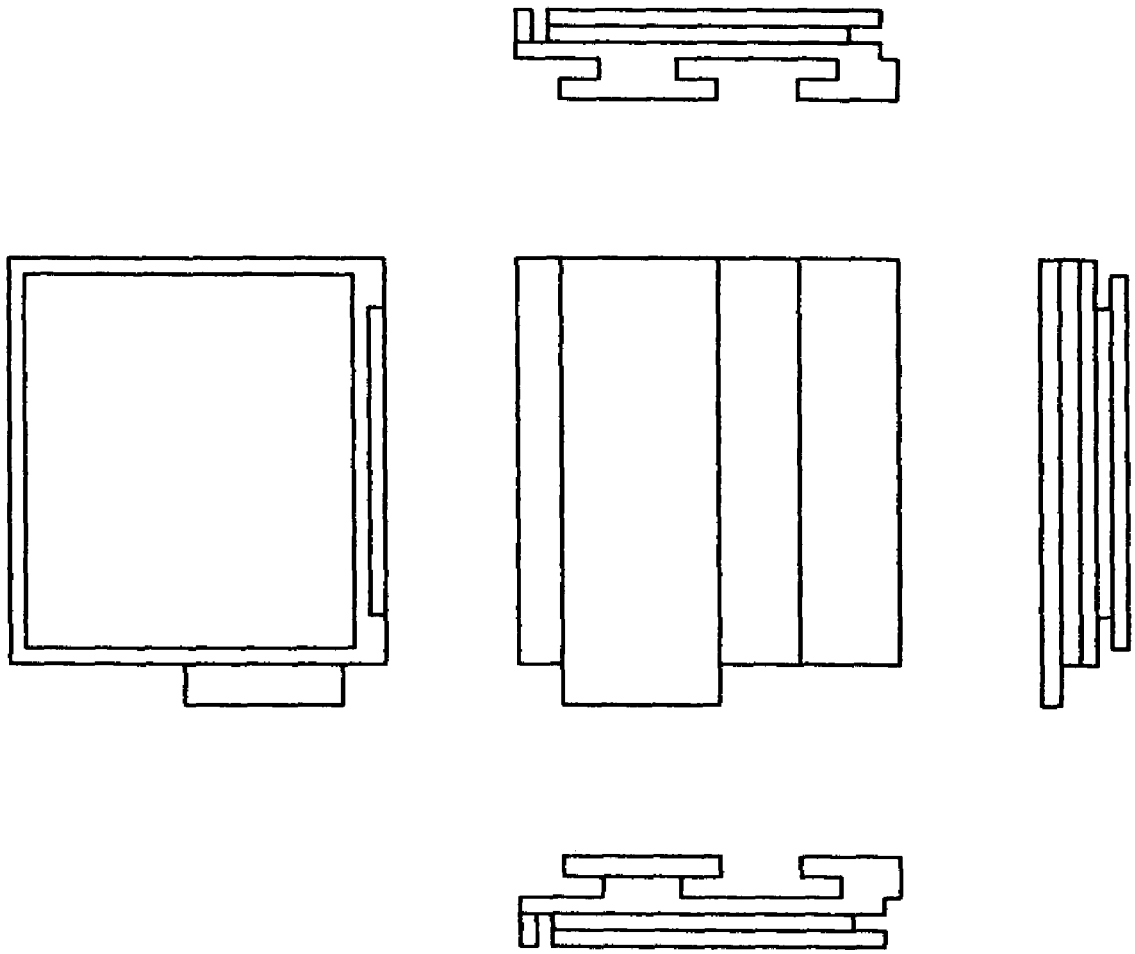
FIG. 3 is set of arranged drawings showing the second plate's exterior face, interior face, end view, and side view.

Looking at FIGS. 1-3, the cube 2 design and the first face plate 4 and second face plate 6 can best be seen. From an exterior view, the cube 2 has six identically configured face plates. Each face plate has one Tee post 8 and one half Tee post 10 formed upon the top side 12 of the plate 18 so as to leave an inverted Tee slot 14 between them and an inverted half Tee slot 16 adjacent the Tee post 8. The inverted Tee slot 14 is complementary to the Tee post 8, while the inverted half Tee slot 16 is complementary to the half Tee post 10. This allows for sliding engagement between first face plates 4, between second face plates 6, and between first face plates 4 and second face plates 6 when they are oriented correctly (rotated 180 degrees with respect to each other.) The off set design face plates when matingly engaged, only slide parallel to the longitudinal axis of the Tees or Slots. The longitudinal axis of the posts and slots on any face on an assembled cube lies perpendicular to the longitudinal axis of the posts and slots on any and all adjacent faces.

The second face plate 6 and the first face plate 4 have substantially similar lengths and width dimensions and are rectangular, but are not square. The length of each face plate is defined as the dimension parallel to the longitudinal axis of the slots and tees thereon and is the largest single physical dimension of the face plates. The width of each face plate is defined as the dimension perpendicular to the longitudinal axis of the tees and slots thereon. The width of each face plate is shorter than the length of each face plate by two times the thickness of the face plate base 18. This allows for the cube 2 to be a regular hexahedron with each visible face having a square configuration when all face plates are assembled into a monolithic structure as the length dimension of each face plate resides adjacent to the width dimension of each adjacent face plate at all edges of the cube 2.

The substantial difference between the first face plate 4 and the second face plate 6 lies in the physical configuration of the bottom sides. The bottom side of the first face plate 20 has three substantially similar linear tabs 24 extending normally therefrom. The bottom side of the second face plate 22 has one linear tab 24 extending normally therefrom and one linear recess 26 that resides adjacent and parallel to the linear tab 24. The second face plate 6 also has a raised upper platform 28 thereon that sits atop a smaller lower platform 30 such that three edges of the upper platform 28 are cantilevered over three edges of the lower platform 30 so as to form three linear grooves 32 between the upper platform 28, the lower platform 30 and the second face plate 6. The thickness of the three slots are dimensioned so as to matingly accept and frictionally engage the tabs 24 of the first face plate 4.

Figure 4:
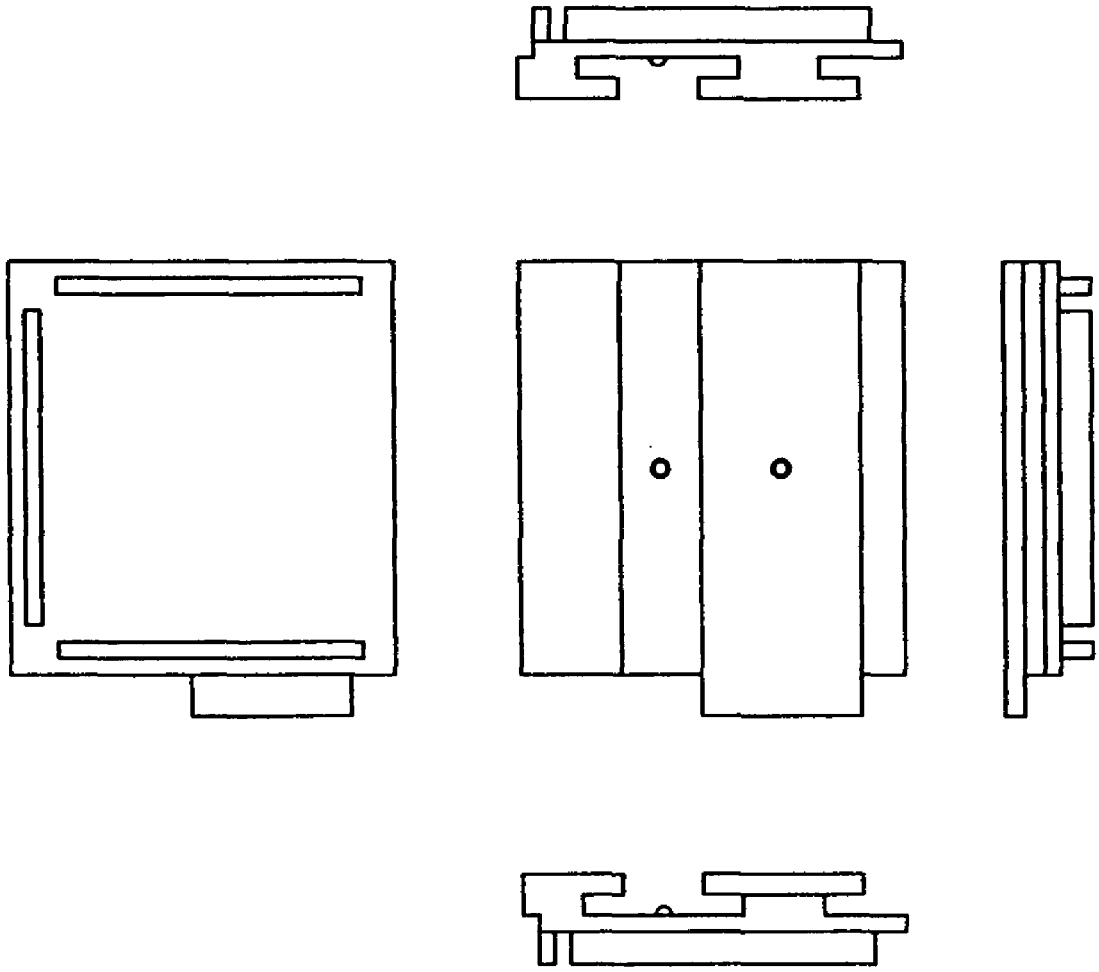
FIG. 4 is set of arranged drawings showing an alternate embodiment first plate's exterior face, interior face, end view, and side view.
Figure 5:
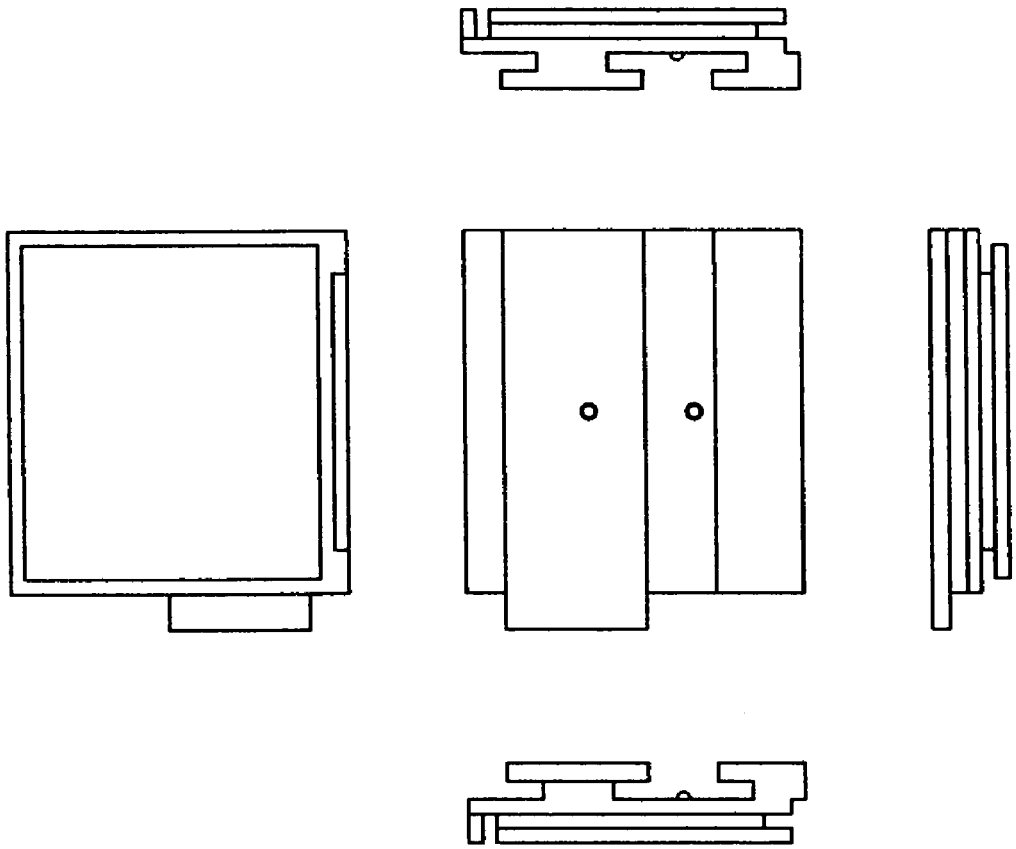
FIG. 5 is set of arranged drawings showing the alternate embodiment second plate's exterior face, interior face, end view, and side view.

FIG. 4 shows the first face plate 4 with a detent 30 and nodule 32 formed thereon. FIG. 5 shows the second face plate with a detent 30 and nodule 32 formed thereon. The nodules 32 on each face plate must both be formed on the Tees or both be formed in the Tee slots. Similarly the detents 30 on each face plate must both be formed on either the remaining Tee slots or on the remaining Tees. The detents 30 align and accept the nodules when adjacent cubes 2 are slidingly engaged, so as to lock the cubes 2 together until an additional force, beyond that required to slide the cubes 2 relative to one another, is applied. This holds an array of cubes in a aesthetic, symmetrical arrangement.

Figure 6:
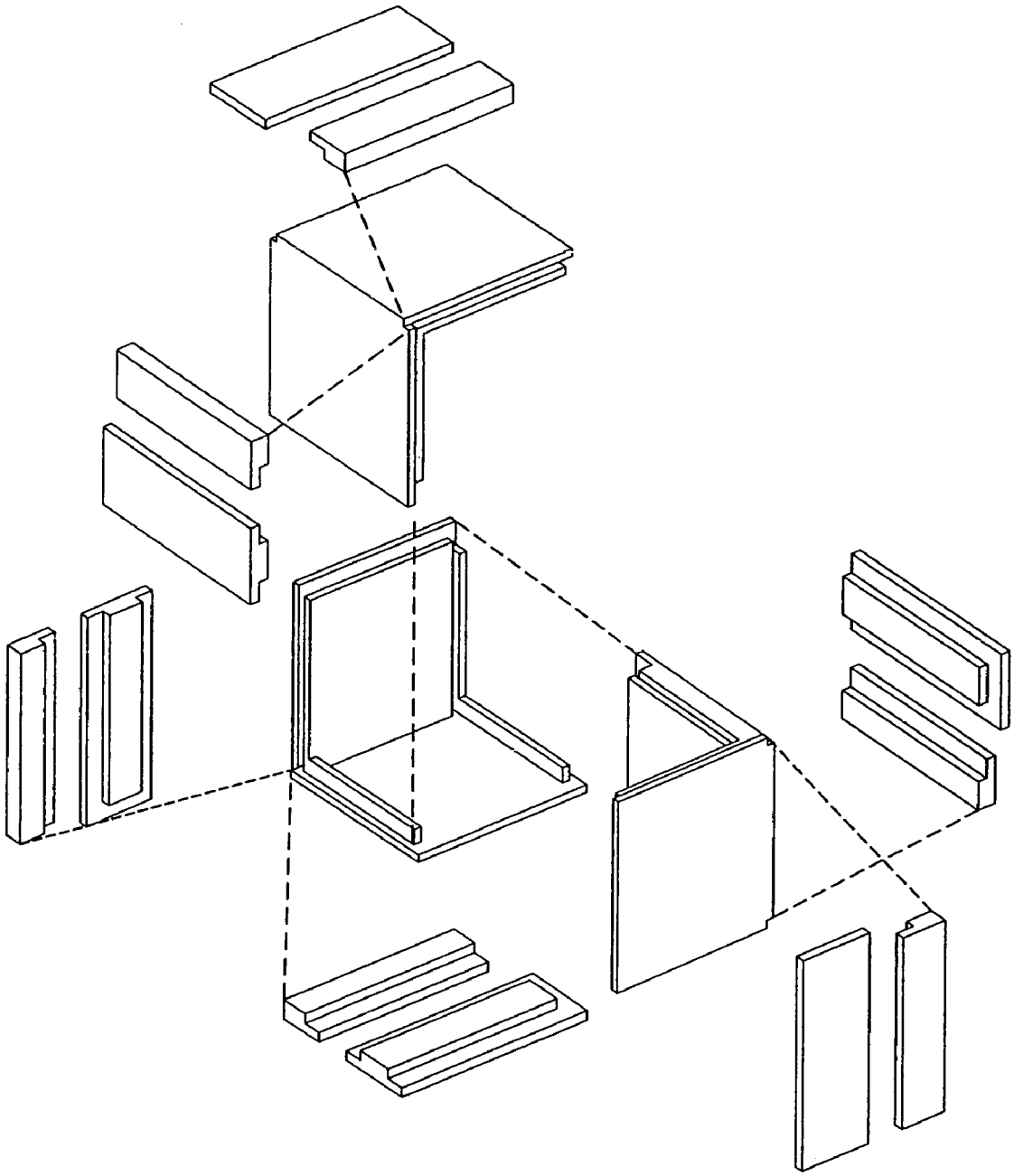
FIG. 6 is an assembly view of a cube made from the interconnection of three plate pairs.
Figure 8:
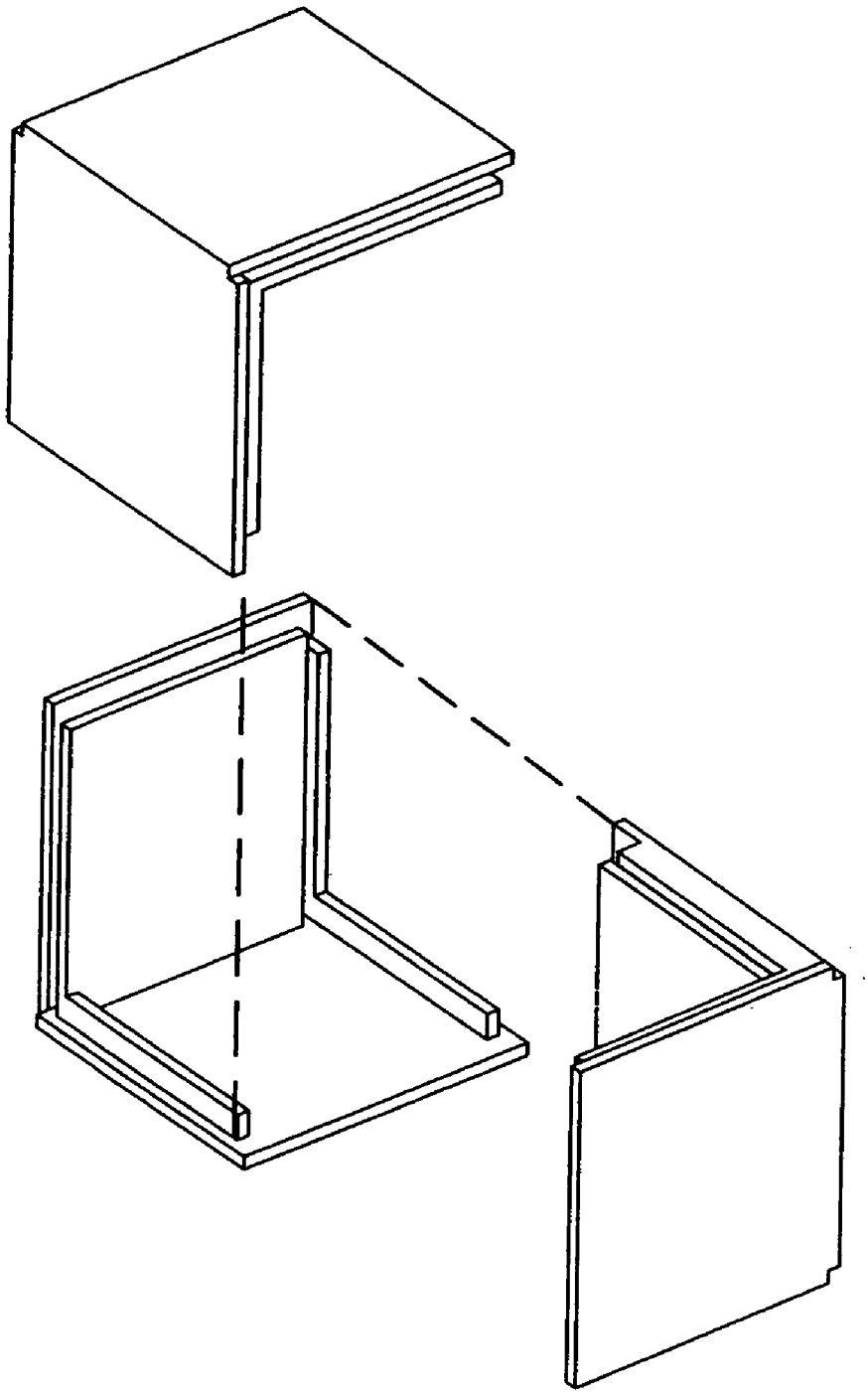
FIG. 8 is an assembly view of a cube made from the interconnection of three plate pairs with the exterior faces' posts removed for visual clarity.

Looking at FIGS. 6 and 8 it can be seen that a cube may be assembled from three substantially similar plate pairs 34. Each plate pair 34 has a first face plate 4 and a second face plate 6 joined along a edge so as to form an L shape wherein the tab 24 on the bottom side of the second face plate 6 contacts one of the tabs 24 on the bottom side of the first face plate 4, also forming an L configuration of the tabs 24. The linear tab 24 residing perpendicular to the other two linear tabs 24 on the bottom side 20 of the first face plate 4 (a length side tab) is engaged into the linear groove 32 adjacent another linear groove 32 and a linear recess 26 (a width side groove) on the bottom side 22 of the second face plate 6. This forms the first face plate 4 and the second face plate perpendicular to one another such that the plate pair 34 has two exposed edge adjacent linear grooves 32, three exposed edge linear tabs 24 and one linear recess 26. The remaining exposed edge of the second face plate 6 has neither a linear tab 24 nor a linear groove 32 formed thereon.

Three plate pairs 34 are joined to make a cube 2 by the engagement of their respective linear tabs 24 into the linear recesses 26 and linear grooves 32 on the adjacent plate pairs 34. Assembly direction arrows 36 and 38 indicate the manner of assembly and how the tabs 24 matingly engage recesses 26 and grooves 32. The assembly of three plate pairs 34 into a cube 2 is accomplished in the following manner. Note, that the designations first plate pair, second plate pair and third plate pair refer only to the order in which the plate pairs are manipulated. There are no physical differences between the three designated plate pairs. The first plate pair is joined to the second plate pair by the insertion of the two L shaped adjacent linear tabs 24 on the first plate pair into the two L shaped adjacent linear grooves 32 on the second plate pair. The third plate pair is joined to the first and second plate pairs by the insertion of the two L shaped adjacent linear tabs 24 on the third plate pair into the two L shaped adjacent linear grooves 32 on the first plate pair while at the same time sliding L shaped linear grooves 32 on the third plate pair into the L shaped linear tabs 24 on the second plate pair.

Such assembly does not depend on which order the three plate pairs 34 are matingly engaged. Such assembly would be well known by one skilled in the art. It is envisioned in one version of the cube as a game the cube 2 may be shipped in an unassembled form of plate pairs 34 or equal sets of first face plates 4 and second face plates 6. Assembly may be part of the puzzle process.

Figure 7:
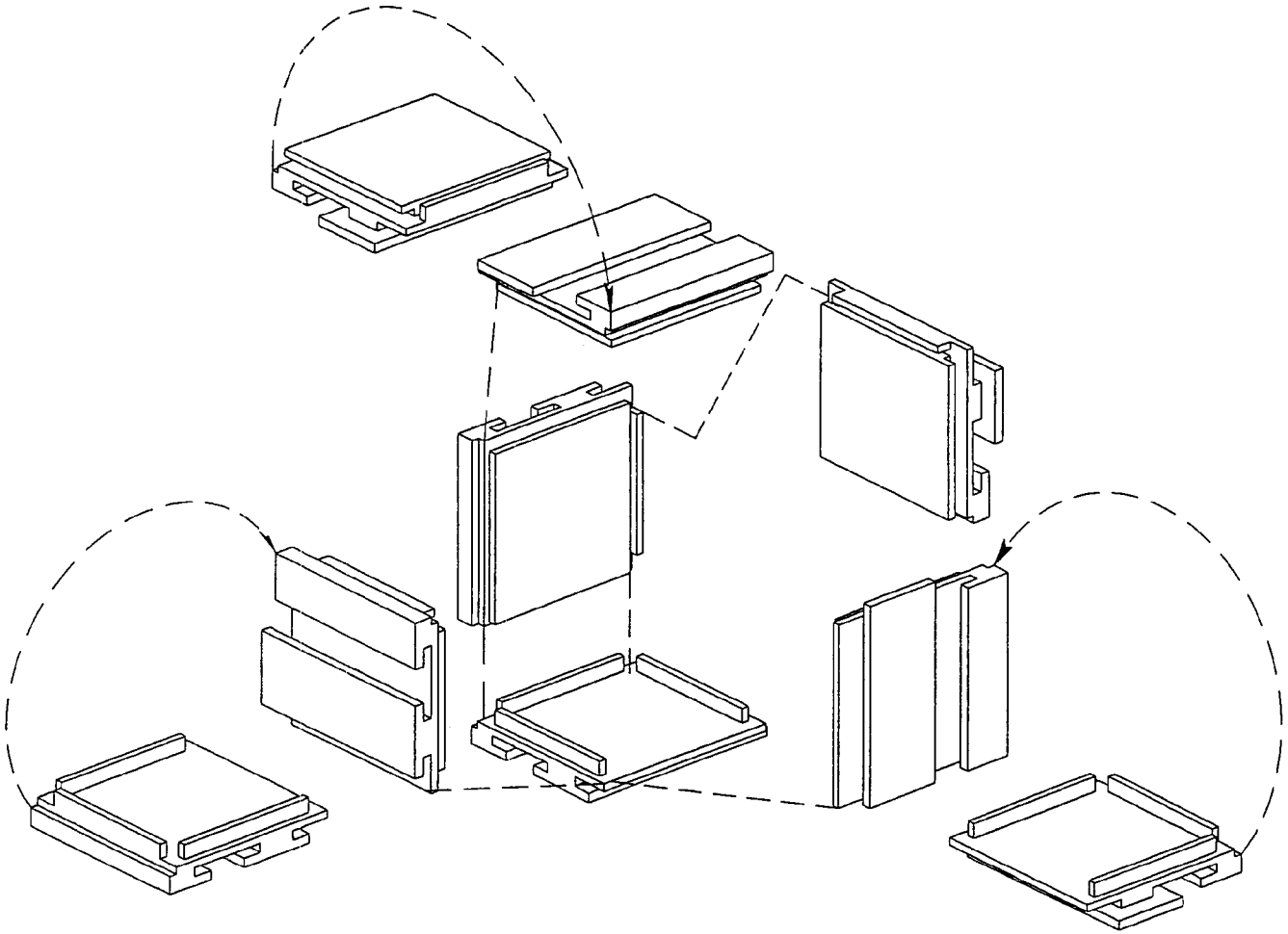
FIG. 7 is an assembly drawing of a cube made from the interconnection of six plates.

FIG. 7 shows the assembly of a cube 2 form six face plates. Three of these are first face plates 4 and three are second face plates 6. Three of the face plates are displayed so as show the bottom faces and top faces. Arced rotation arrows 40 42 and 44 flip the associated face plates so as to illustrate the orientation of the linear tabs 24, linear recesses 26, upper platforms 28, lower platforms 30, linear grooves 32, Tee slots 14, half Tee slots 16, Tee posts 8 and half Tee posts 10 thereon each face plate. This assembly is accomplished by a combination of the various assembly moves discussed in the assembly of plate pairs 34 and in the assembly of plate pairs 34 into a cube 2. Such assembly can begin with any two face plates and can add on any other plate. The order of the assembly of the first and second face plates to form a cube 2 does not matter and thus assembly can be accomplished in a number of different ordered steps.

The design configuration of the first face plate 4 and the second face plate 6 is such that the plate pairs 34 may also be fabricated, most likely by extrusion, as a single plate pair unit.

Looking at FIGS. 9 to 13, five different embodiments of rails can be see. All rails are linear members also designed for fabrication by extrusion or injection molding. Each of the rails has a face bearing the same physical configuration of Tee slots 14, half Tee slots 16, Tee posts 8 and half Tee posts 10 as is found on the first face plate 4 and second face plate 6. In this manner the cubes 2 as well as the rails matingly engage for slide positioning of any cube 2 on any of the rails. A grouping of multiple cubes 2 and rails are used to form a construction or erector type set. This allows for individual cubes 2, rails, rail arrays and/or cube arrays to be linked into arrangements to resemble architectural structures, vehicles, animals and the such.

Figure 10:
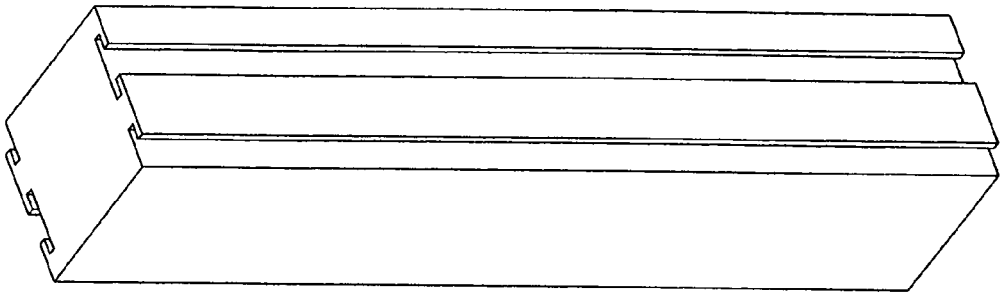
FIG. 10 is an axonometric view of a two face rail.
Figure 9:
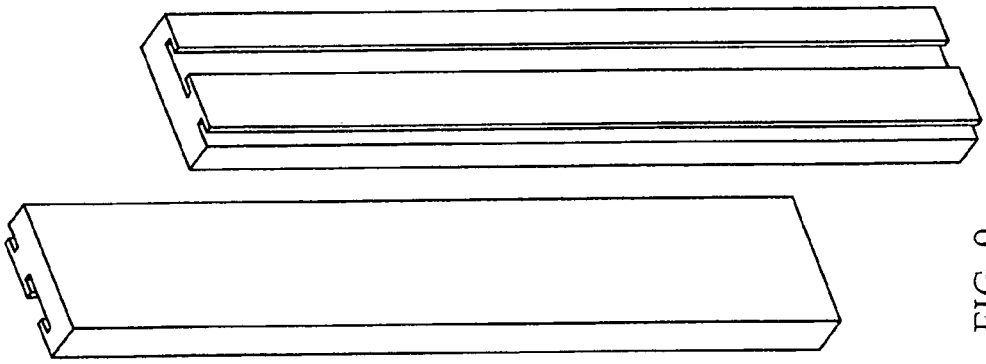
FIG. 9 is an axonometric front and back view of a one face rail.
Figure 11:
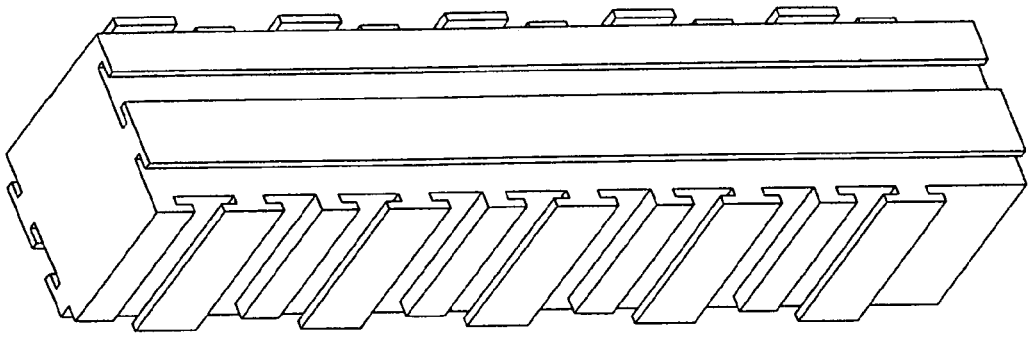
FIG. 11 is an axonometric view of a four face rail.
Figure 12:
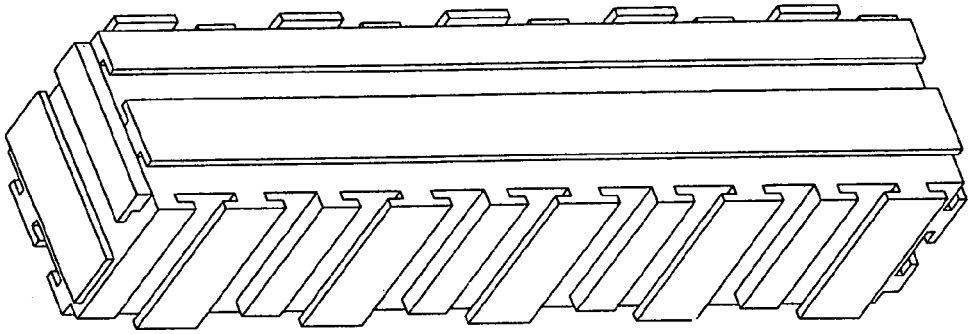
FIG. 12 is an axonometric view of a six face rail.
Figure 13:
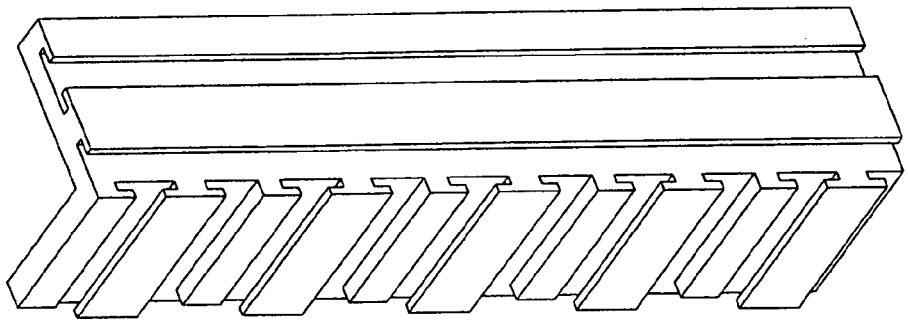
FIG. 13 is an axonometric view of a two face "L" rail.

FIG. 9 shows a one face rail 48 with a single profiled face having a Tee slot 14, half Tee slot 16, Tee post 8 and half Tee post 10, and on the remaining surfaces, a smooth back 50, smooth sides 52 and smooth rectangular ends 54. FIG. 10 shows a two face rail 56 having two profiled faces on opposing sides of the linear member. The remaining faces (sides and ends) are smooth. FIG. 11 shows a four face rail 58 having four profiled faces on the linear member's sides and smooth square ends 60. The Tee slot 14, half Tee slot 16, Tee post 8 and half Tee post 10 arrangements on each of the six faces of the linear member are perpendicular to the arrangements on all adjacent faces. FIG. 12 shows a six face rail 62 having six profiled faces on the linear member's sides as well as profiled square ends 64. The Tee slot 14, half Tee slot 16, Tee post 8 and half Tee post 10 arrangements on each of the six faces (sides and ends) of the linear member are perpendicular to the arrangements on all adjacent faces. FIG. 13 shows a two face "L" rail 66 with adjacent exterior profiled faces and the remaining faces smooth. The Tee slot 14, half Tee slot 16, Tee post 8 and half Tee post 10 arrangements on the adjacent exterior faces reside normal to each other.

Figure 14:
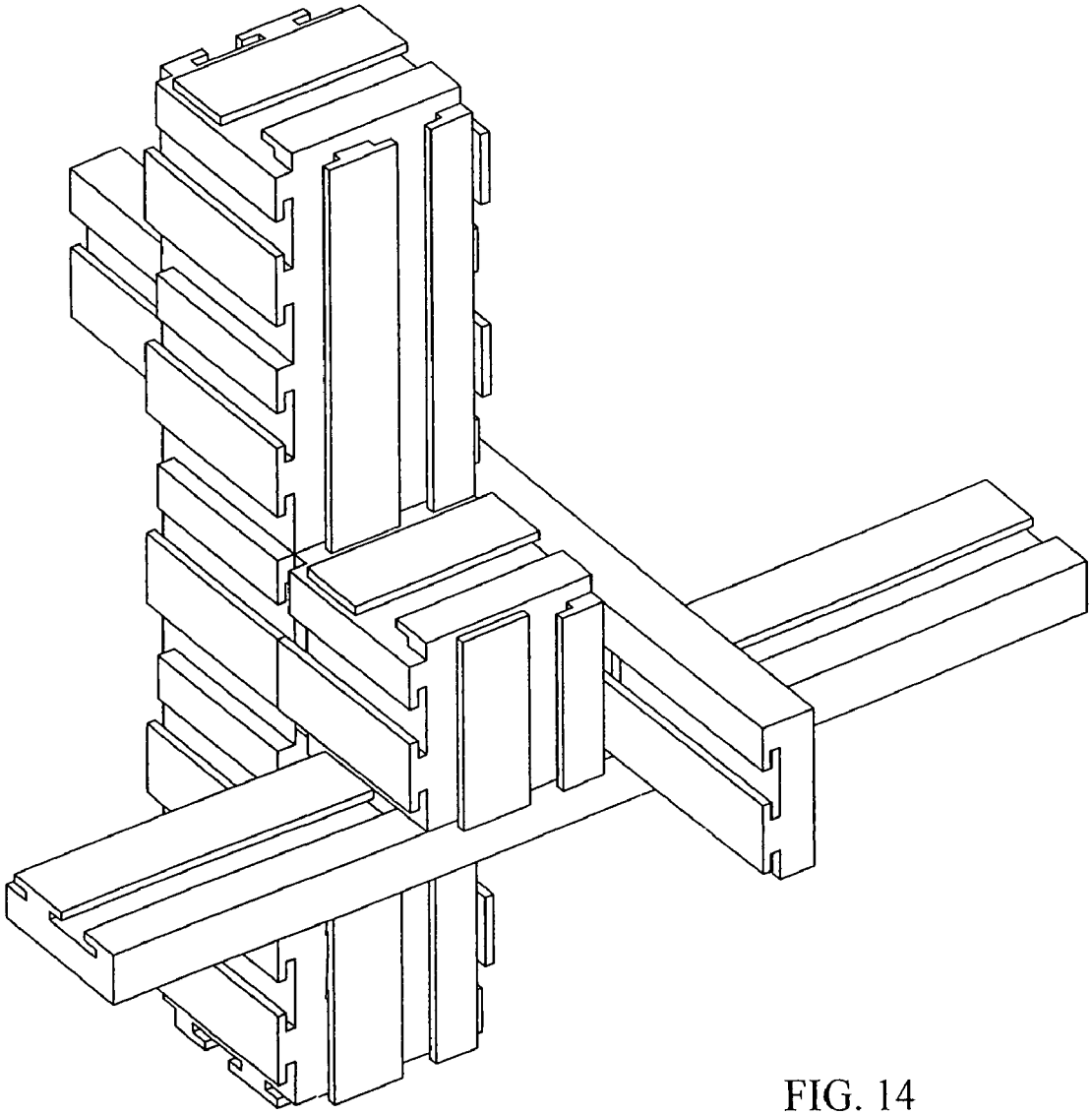
FIG. 14 is an axonometric view of a construction set of rails and a cube.

Through the use of the above rails and cubes 2 a plethora of structures can be made by the creative mind. FIG. 14 best illustrates the interplay assembly between a cube 2, two one face rails 48 and a six face rail 62.

FIGS. 15 to 24 depict an array of 27 cubes 2 as used for a gaming cube. This specific number of cubes 2 has no significance to the operation of the cubic arrays and other cubic multiples such as 8, 64, 125 or non multiple such as 14, 35, 61 may also be used, although the cube 2 as utilized as a game need not be held to a cubic arrangement of cubes 2.

The series of drawings showing the physical manipulation of the 27 cube array involves cube moves, row moves and slab moves to facilitate the movement of individual cubes to their desired locations. In a cube move, a cube 2 is slidingly urged about at least one other cube 2 or rail to a desired location within or about the array. In a row move, a linear joined set of cubes are simultaneously urged about at least one other cube 2 or rail to a desired location within or about the array. In a block move, a plane of joined cubes are urged about at least one other cube 2 or rail to a desired location within or about the array. The purpose of the cube 2 as a member of cubes in a gaming set (gaming cube) is to arrange the exposed faces of the cube in a manner so as to complete a numbered, colored or designed pattern about the gaming cube's exterior. It may also be to arrange the cubes 2 in a unitary physical configuration.

Figure 15:
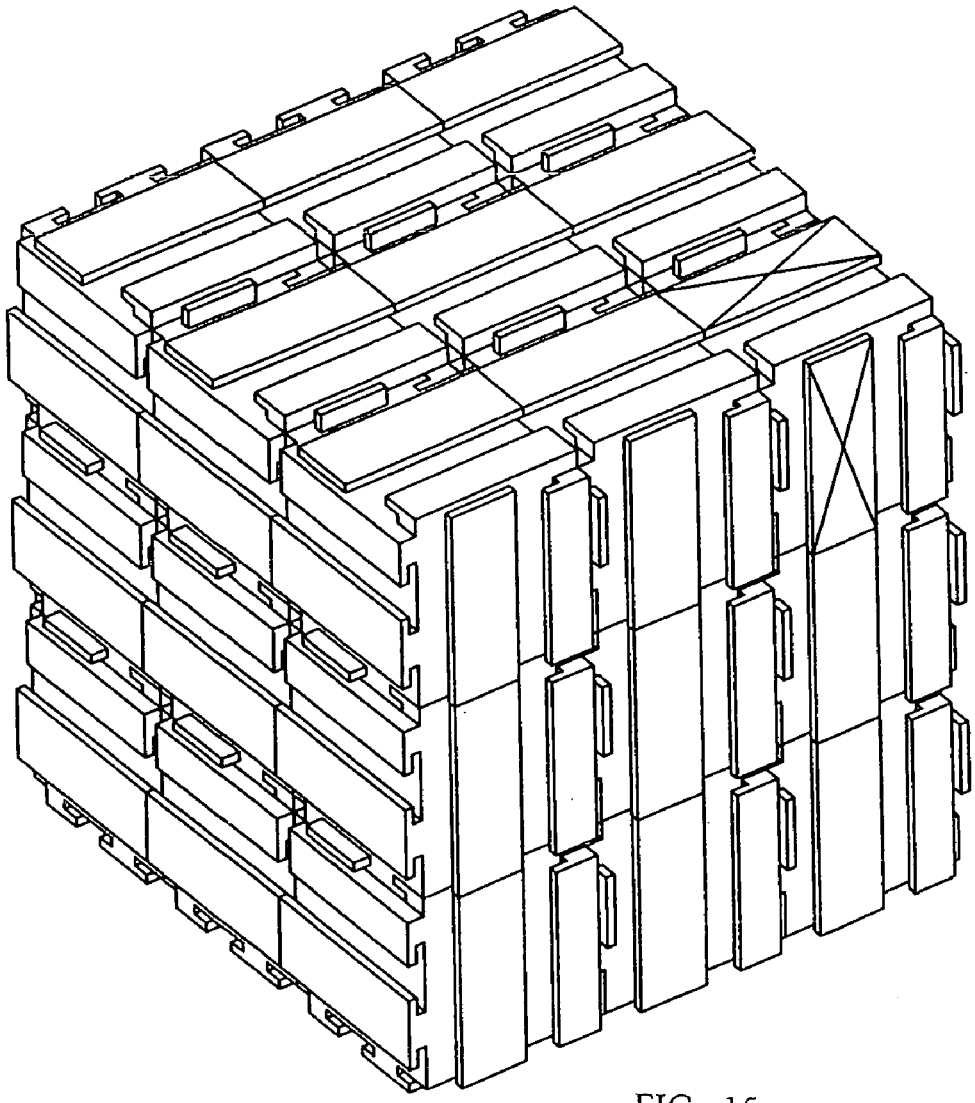
FIGS. 15 to 24 are a series of slab, row and solo cube moves of a 27 cube puzzle array, illustrating the applicability of the cube as a component of a hand manipulation puzzle.
Figure 16:
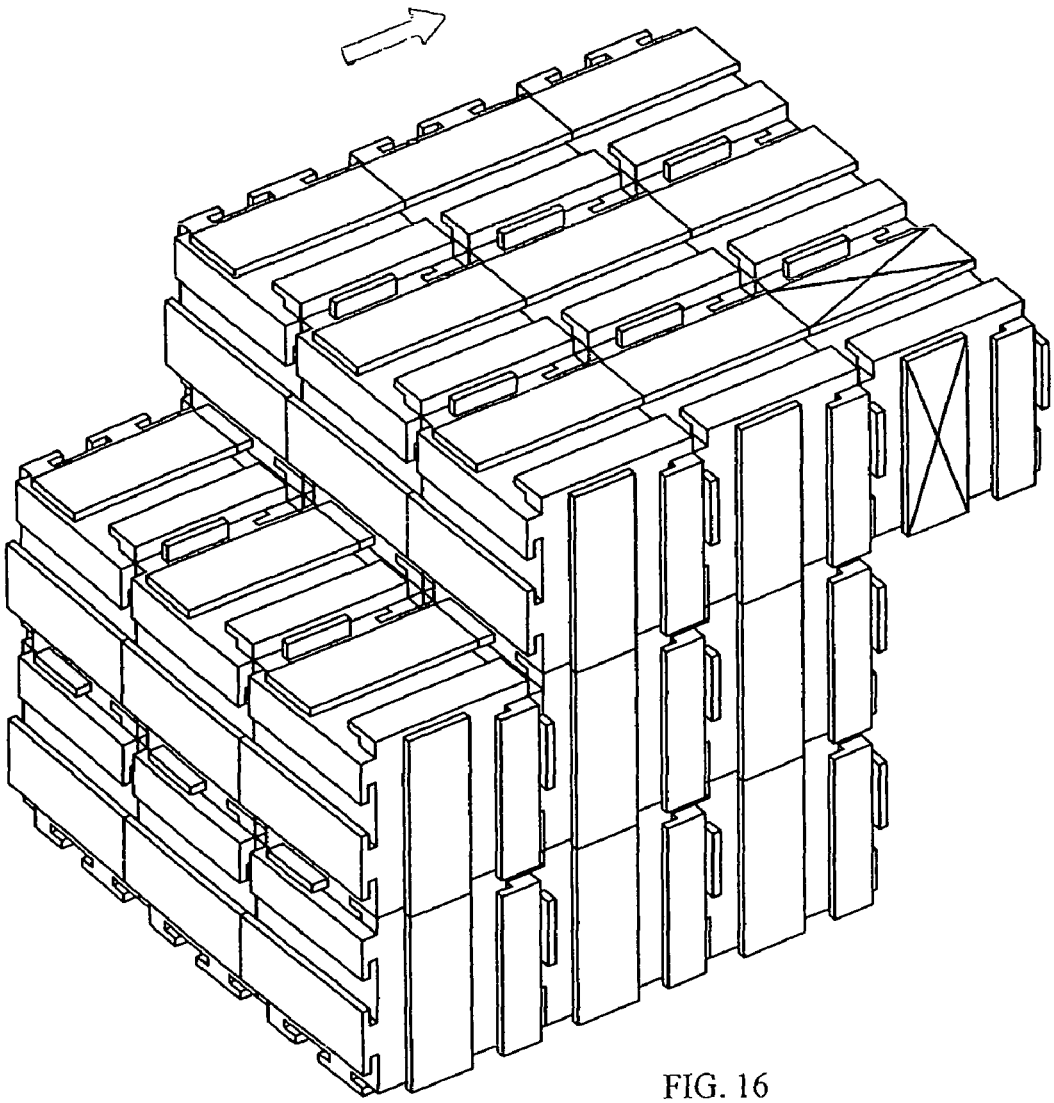
Figure 17:
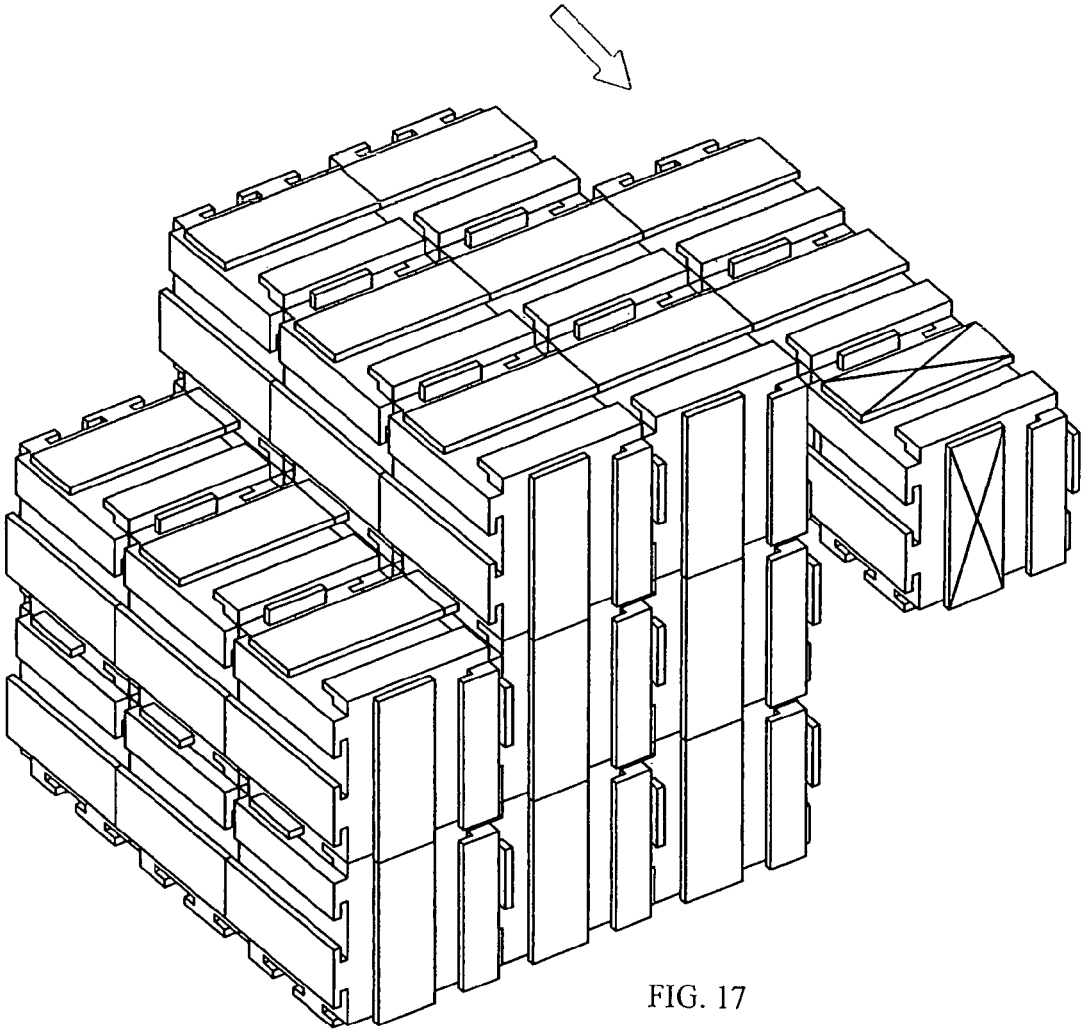
Figure 18:
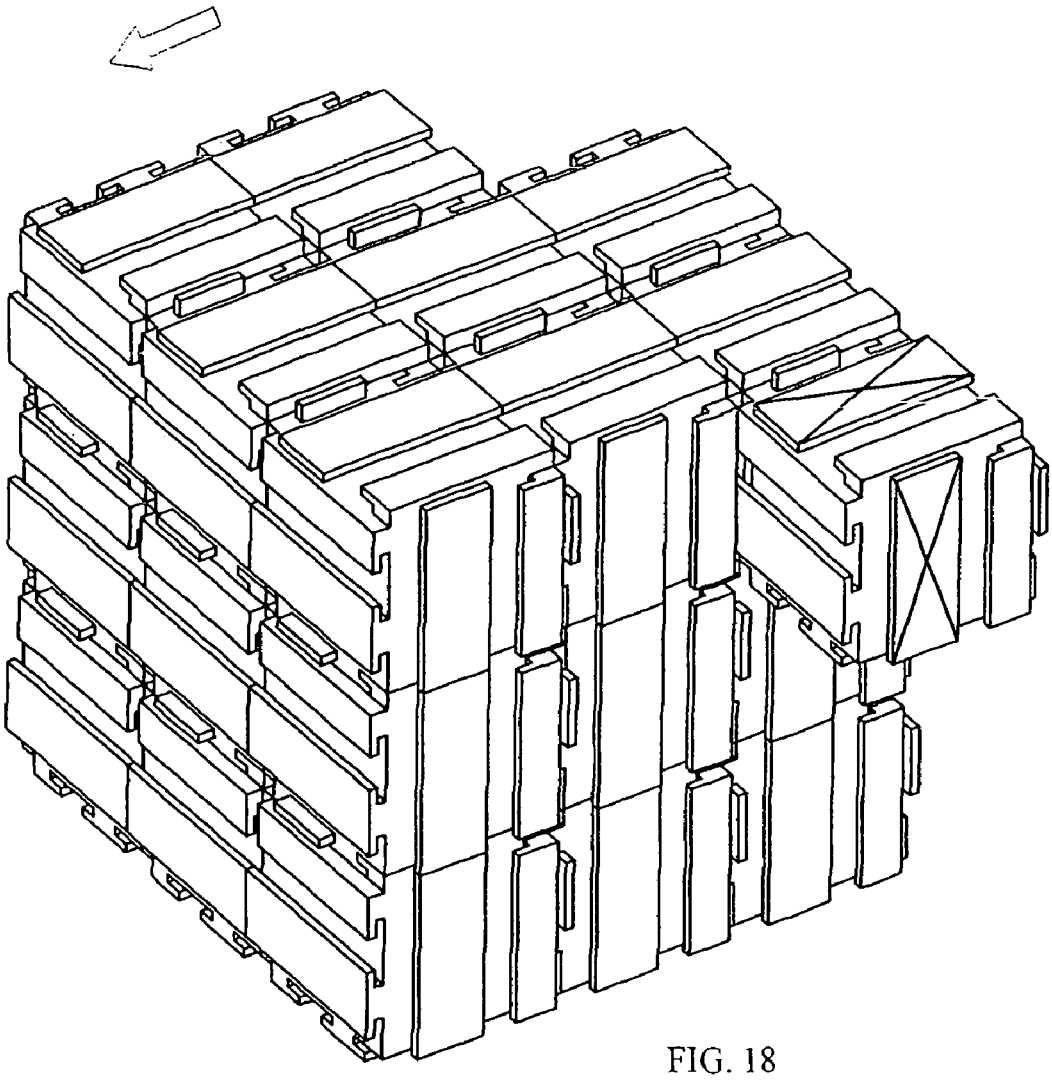
Figure 19:
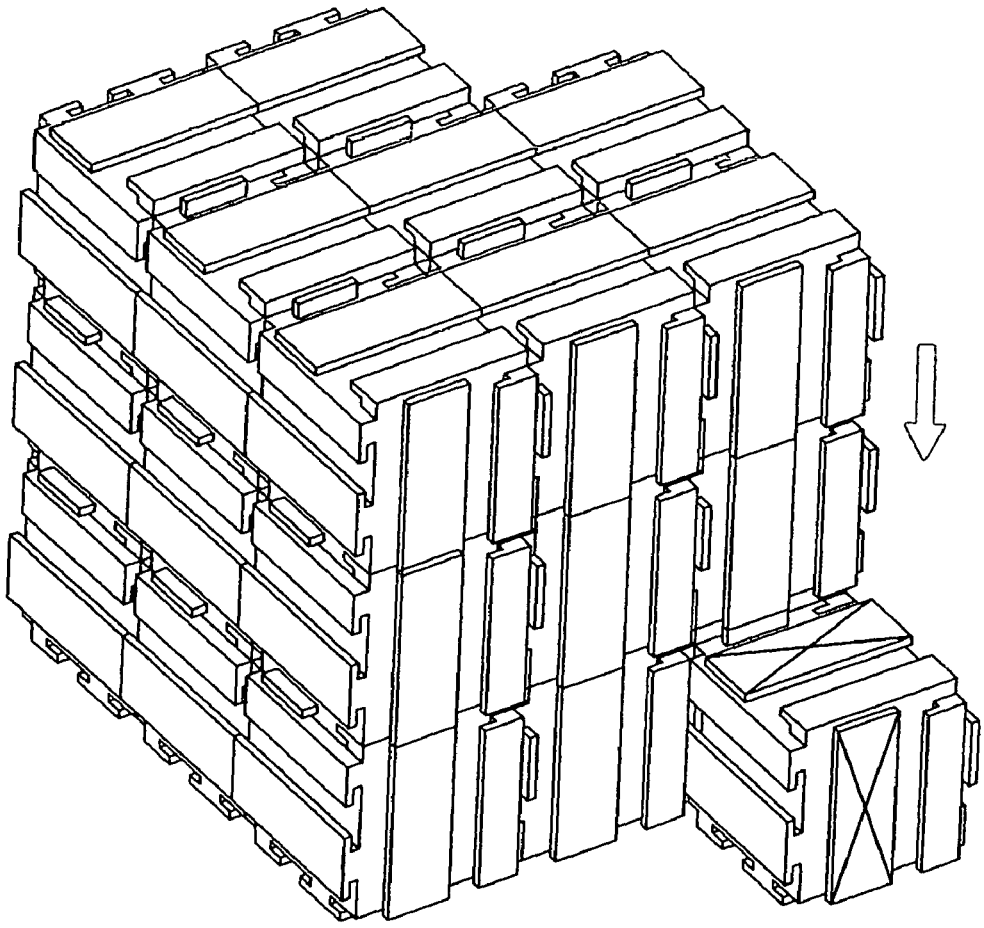
Figure 20:
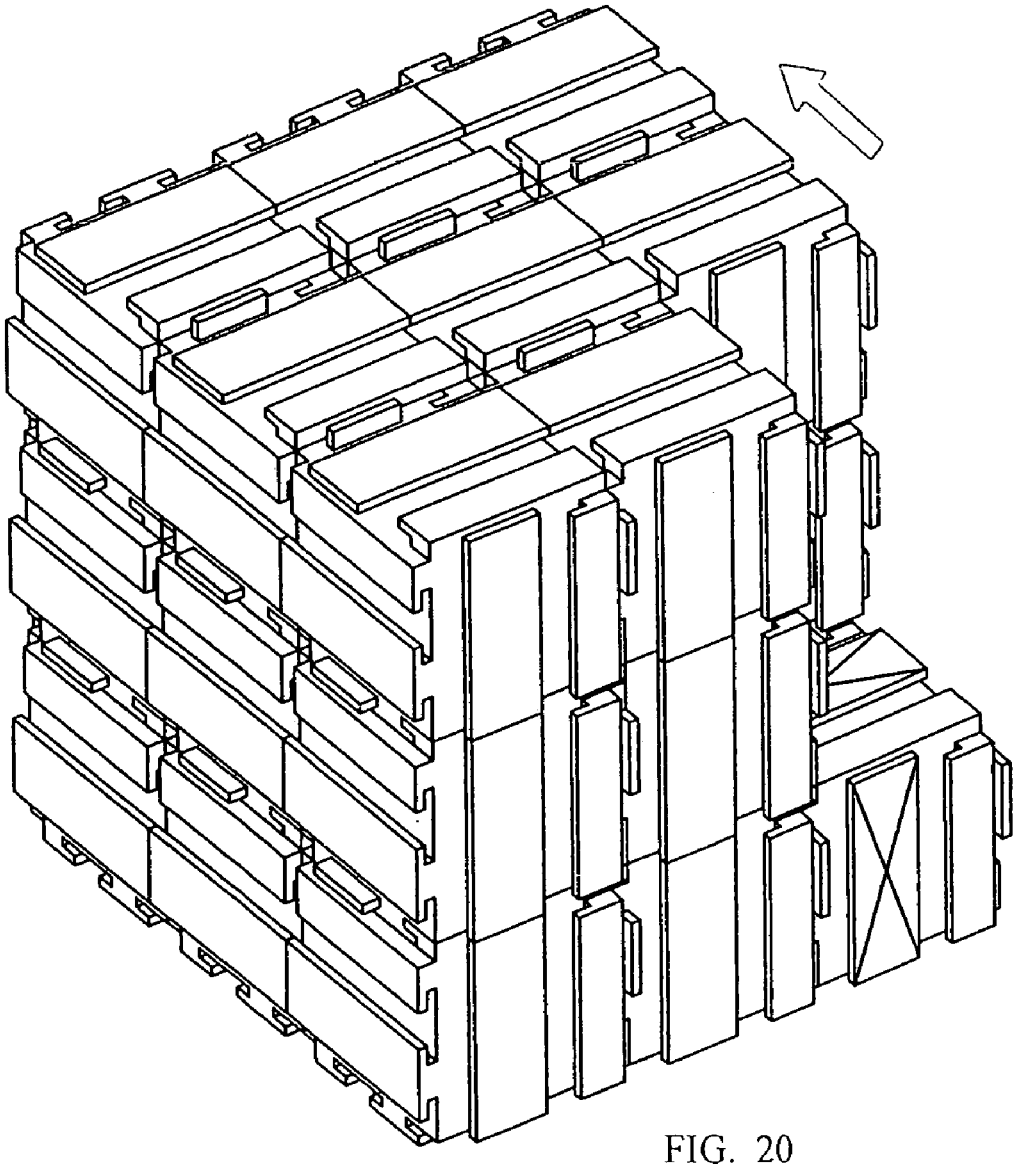
Figure 21:
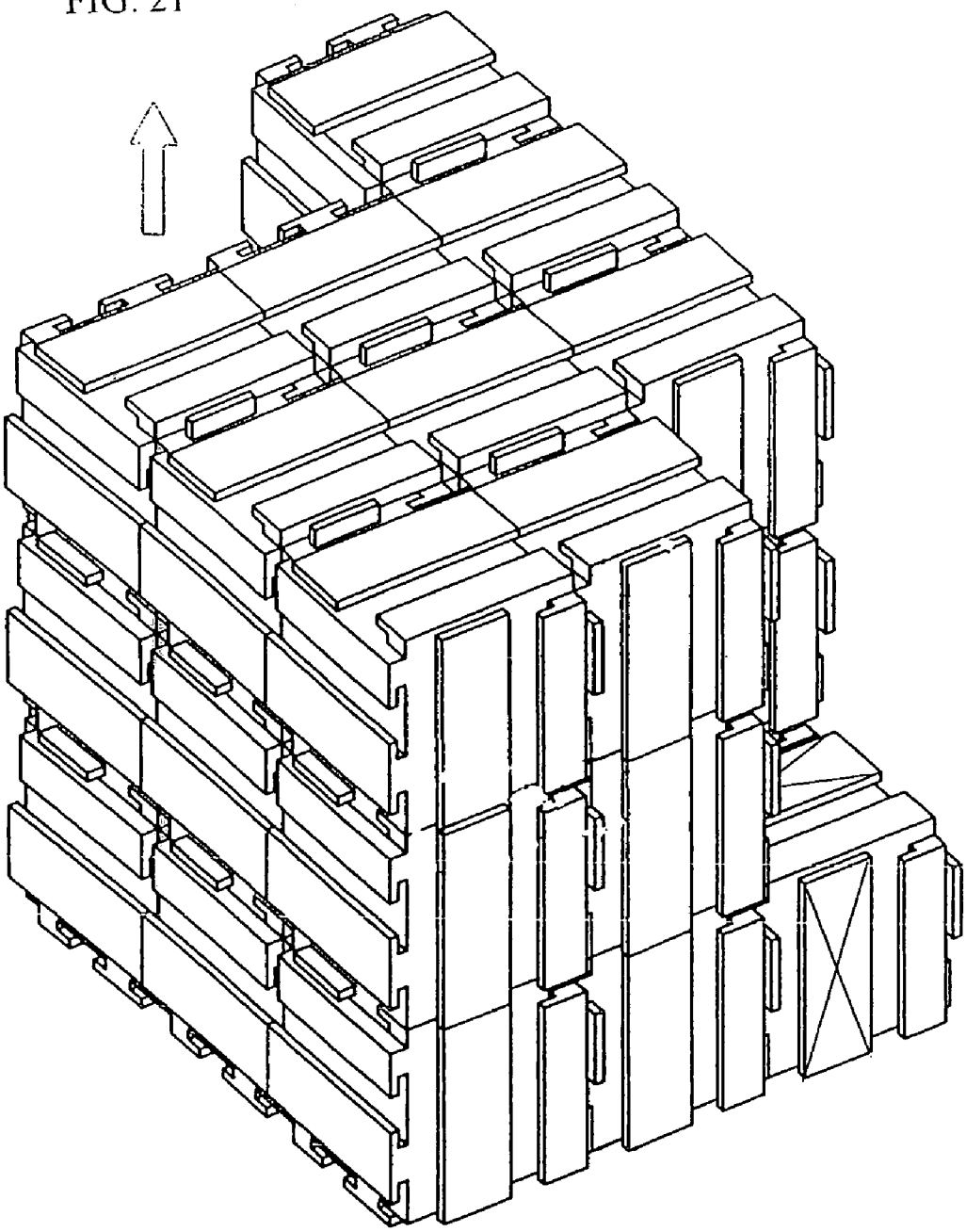
Figure 22:
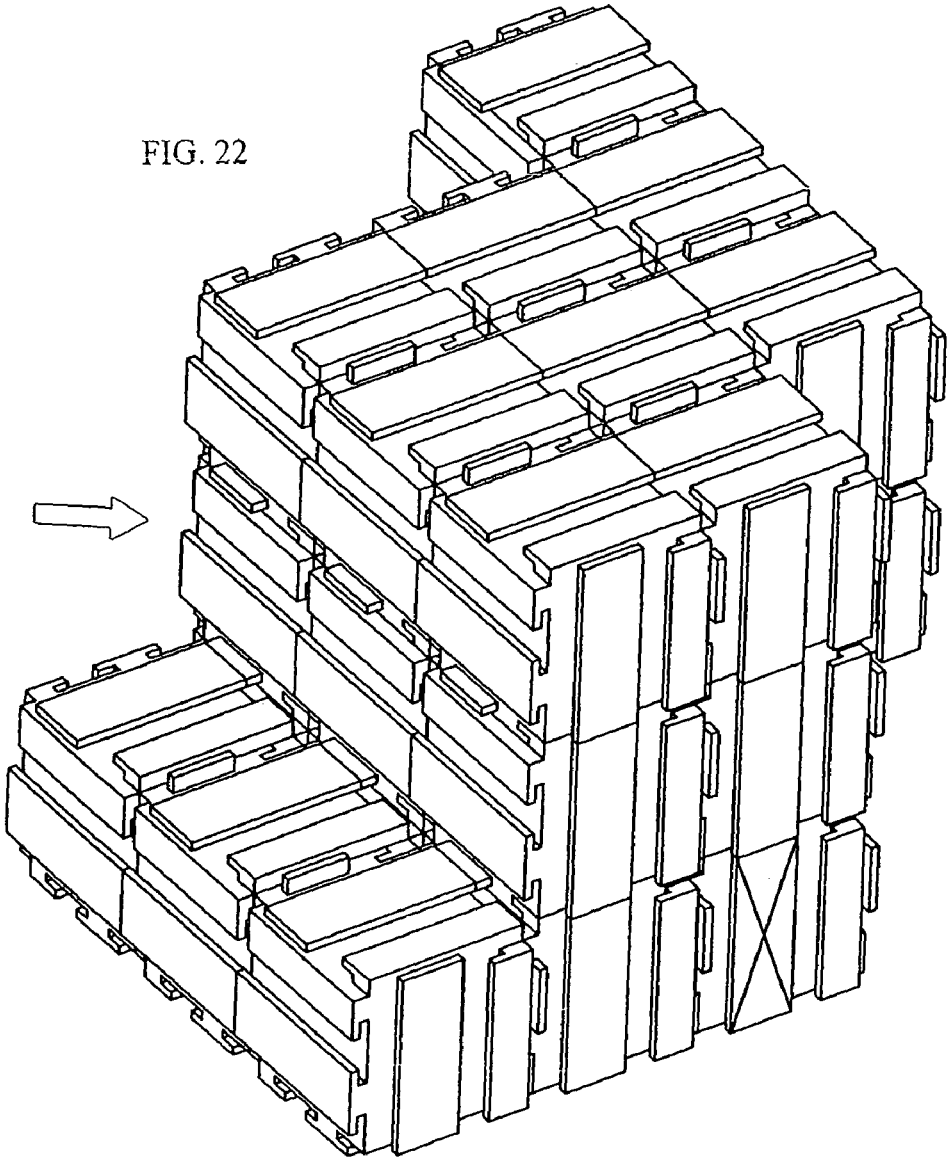
Figure 23:
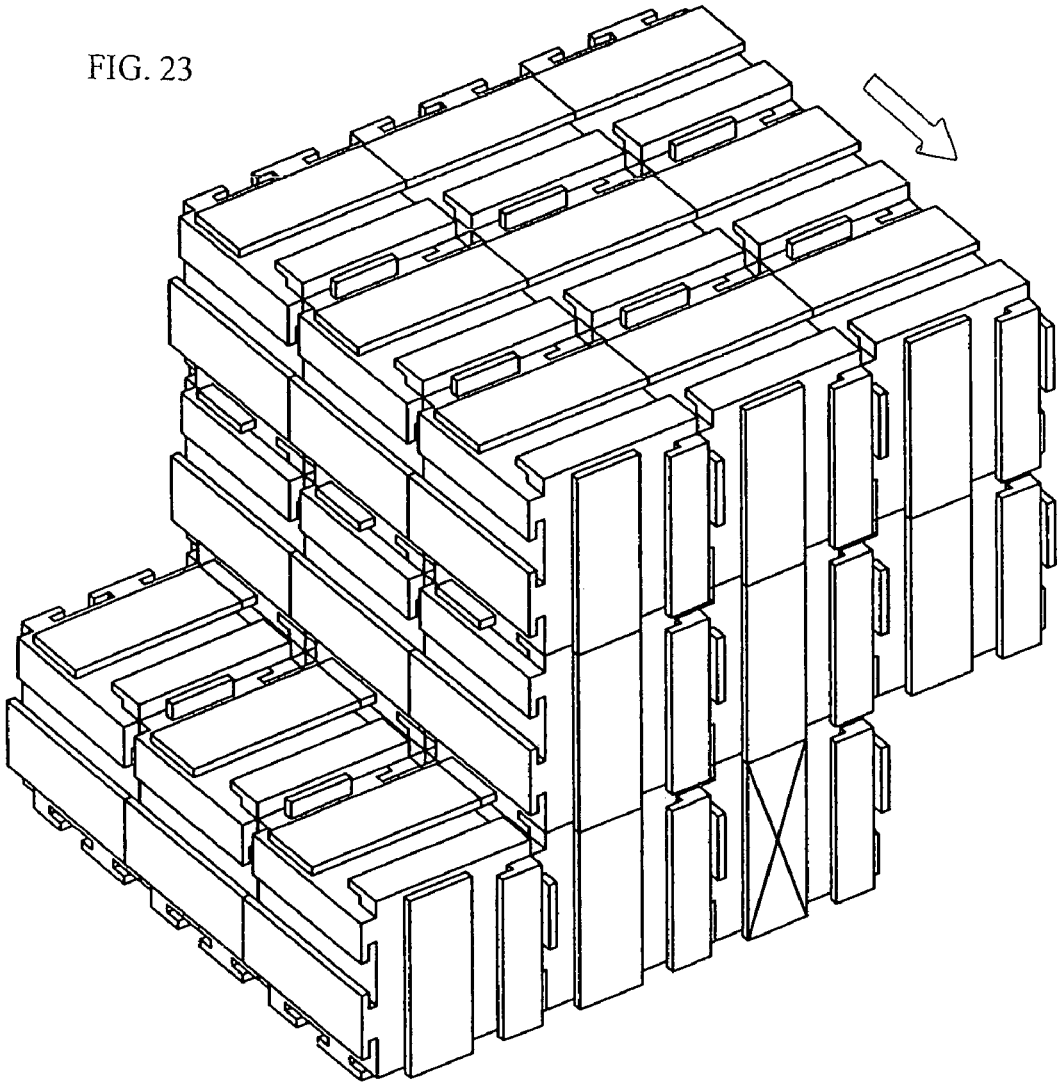
Figure 24:
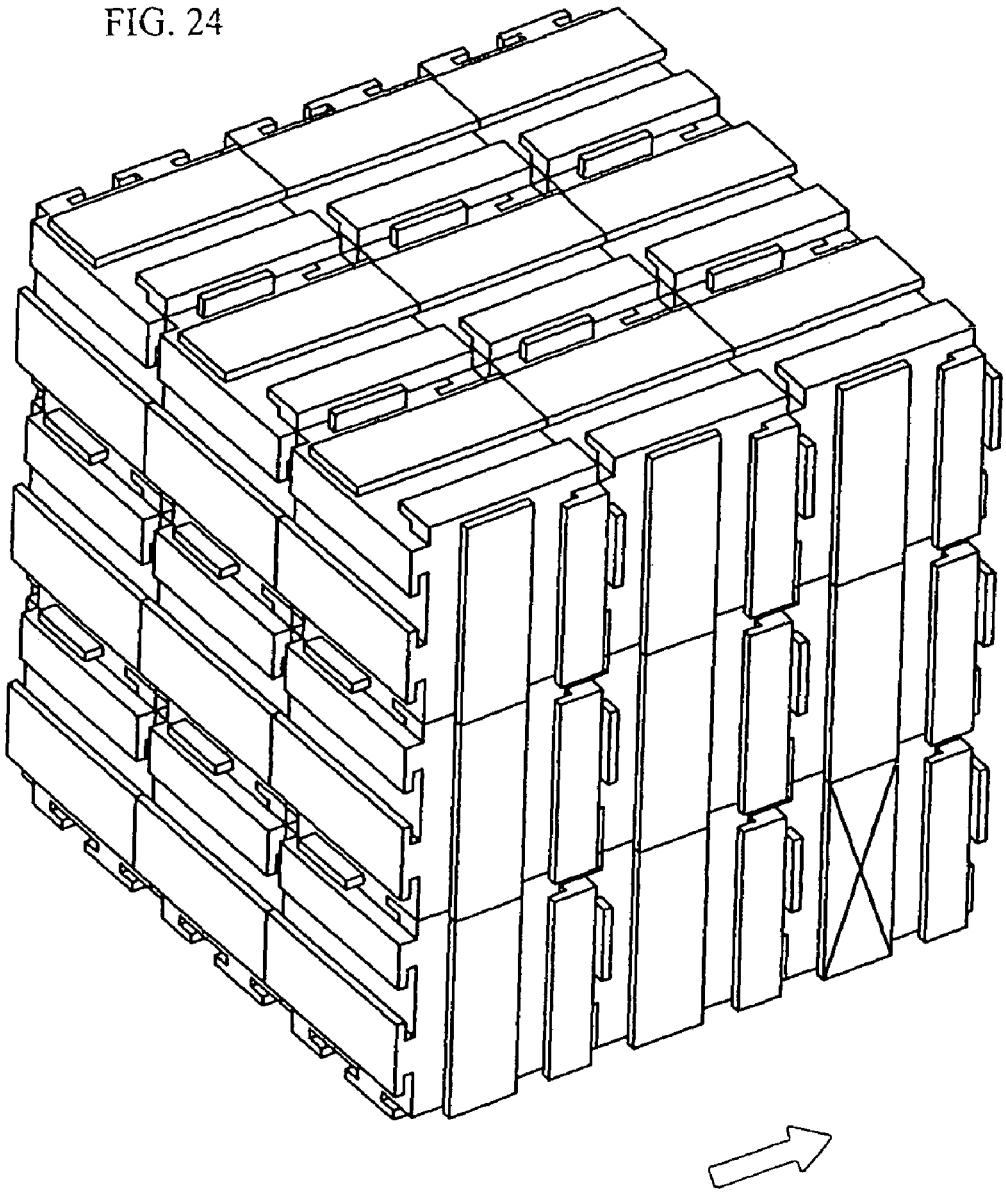

FIGS. 15 to 24 show how a specific cube's location may be altered within the same overall gaming cube configuration using cube moves, row moves and slab moves. FIG. 15 shows the upper right corner location of the X cube 70 within the gaming cube 68 assembled as a regular hexahedron. The upper plane is slid to the right (FIG. 16—slab move as indicated by direction arrow 72). The upper plane's right row is slid forward (FIG. 17—row move as indicated by direction arrow 74). The upper plane is slid back to its original location (FIG. 18—slab move as indicated by direction arrow 76). The X cube is slid to down the gaming cube's front face to the lowest right corner (FIG. 19—cube move as indicated by direction arrow 78). The right side plane is slid back along the gaming cube 68 by a distance of one cube (FIG. 20—slab move as indicated by direction arrow 80). Two of the cubes on the rear face are slid up the rear face by a distance of one cube (FIG. 21—row move as indicated by direction arrow 82). The entire middle and top planes of the gaming cube 68 are slid forward for a distance of one cube (FIG. 22—slab move as indicated by direction arrow 84). The top row on the right side is slid forward by a distance of one cube (FIG. 23—row move as indicated by direction arrow 86). Finally the bottom plane is slid back underneath the top and middle planes by a distance of one cube (FIG. 24—slab move as indicated by direction arrow 74). Following this sequence of moves, the X cube has been moved from the upper right corner to the lower right corner. By utilizing numerous combinations of moves specifically designed to move a cell to a desired location, the game can be completed.

The above description will enable any person skilled in the art to make and use this invention. It also sets forth the best modes for carrying out this invention. There are numerous variations and modifications thereof that will also remain readily apparent to others skilled in the art, now that the general principles of the present invention have been disclosed.

With the intended use of the cube as a component of a thinking man's puzzle, there are a plethora of puzzles envisionable based on the sliding engagement of the individual cubes. These may involve the different coloring, patterning or numbering of the cubes' external plates such that a game of specific arrangement of the colors, numbers or patterns is accomplished. In one such embodiment, in a cubic array of 27 cubes, the exposed exterior faces of all the cubes may be of one color while the non exposed exterior plates have the same or a different color thereon. By a manipulation of numerous slab, row and solo cube moves, the exposed exterior faces of all the cubes may changed. Similar puzzle games may be mathematically or visually oriented.

It is also known that a matingly engageable dovetail formation of the T post, half T post, T slot and half T slot may be utilized as an alternate embodiment to that illustrated and described herein.

Having thus described the invention, what is claimed as new and desired to be secured by Letters Patent is as follows:

1. A regular hexahedron comprised of:

three rectangular first plates each having a rectangular top surface and a rectangular bottom surface and having a dimension of length and a dimension of width;

three rectangular second plates each having a rectangular top surface and a rectangular bottom surface and having substantial similar said dimensions of length and said dimension of width as said rectangular first plate;

wherein said dimension of length exceeds said dimension of width and wherein said all rectangular plates have a substantially similar top surface having a "Tee" (T) shaped post traversing the length of said top surface and residing parallel to, but offset from, a longitudinal axis residing in the length dimension of said top surface, and a ½ "Tee" (½ T) shaped post residing parallel to said "Tee" (T) shaped post and adjacent to a top edge such that a complementary inverted "Tee" (T) shaped slot is formed therebetween said ½ "Tee" (½ T) shaped post and said "Tee" (T) shaped post, and a complementary inverted ½ "Tee" (½ T) shaped opening is formed adjacent to said "Tee" (T) shaped post, and wherein said longitudinal axis of each said rectangular plate resides perpendicular to said longitudinal axis of all rectangular plates with which it shares a single, common edge, so as to allow sliding engagement in an x, a y and a z axis about an array of connected second, identical regular hexahedrons by the engagement of said T shaped post and said ½ T shaped post of one plate of said regular hexahedron with the complementary T shaped slot and ½ T shaped opening of said second regular hexahedron.

2. The regular hexahedron of claim 1 wherein said bottom surface of said first rectangular plate has two length edges and two width edges and further comprises three substantially similar linear tabs extending normally from said first rectangular plate bottom surface adjacent and parallel to three of said edges.

3. The regular hexahedron of claim 2 wherein said bottom surface of said second rectangular plate has two length edges and two width edges and further comprises:

one linear tab extending normally from said second rectangular plate bottom surface and resides adjacent one of said edges;

a raised upper platform thereon that sits atop a smaller lower platform that resides on said second rectangular plate bottom surface such that three edges of said upper platform are cantilevered over three edges of said lower platform so as to form three linear grooves that reside parallel to three of said edges; and one linear recess that resides adjacent and parallel to said linear tab and between said raised linear platform and said linear tab.

4. The regular hexahedron of claim 3 wherein said linear tabs on said first rectangular plate reside adjacent two said width edges and one said length edge.

5. The regular hexahedron of claim 3 wherein said linear grooves on said second rectangular plate bottom surface reside adjacent to two of said length edges and one of said width edges, and wherein said linear tab extending normally from said second rectangular plate bottom surface resides adjacent one of said width edges.

6. The regular hexahedron of claim 5 wherein said linear tabs are dimensioned for mating engagement therein said linear recess and said linear grooves.

7. The regular hexahedron of claim 6 wherein said first rectangular plate has a thickness dimension between said top surface and said bottom surface and wherein said length dimension of said first and second rectangular plates exceeds said width dimension of said first and second rectangular plates by twice the said thickness of said first rectangular plate.

8. The regular hexahedron of claim 3 wherein said linear tabs on said first rectangular plate reside adjacent two said length edges and one said length edge.

9. The regular hexahedron of claim 8 wherein said linear grooves on said second rectangular plate bottom surface reside adjacent to two of said length edges and one of said width edges, and wherein said linear tab extending normally from said second rectangular plate bottom surface resides adjacent one of said width edges.

10. The regular hexahedron of claim 9 wherein said first rectangular plate has a thickness dimension between said top surface and said bottom surface and wherein said length dimension of said first and second rectangular plates exceeds said width dimension of said first and second rectangular plates by twice the said thickness of said first rectangular plate.

11. The regular hexahedron of claim 10 wherein said rectangular top surfaces of said rectangular first and second plates have a color thereon.

12. The regular hexahedron of claim 9 wherein said rectangular top surfaces of said rectangular first and second plates have a number thereon.

13. The regular hexahedron of claim 12 wherein said rectangular top surfaces of said rectangular first and second plates have a pattern thereon.

14. A construction set toy comprised of:

at least one linear rail member; and at least one cube, wherein said cube is comprised of three rectangular first plates each having a rectangular top surface and a rectangular bottom surface and having a dimension of length and a dimension of width; three rectangular second plates each having a rectangular top surface and a rectangular bottom surface and having substantial similar said dimensions of length and said dimension of width as said rectangular first plate; wherein said dimension of length exceeds said dimension of width and wherein said all rectangular plates have a substantially similar top surface having a "Tee" (T) shaped post traversing the length of said top surface and residing parallel to, but offset from, a longitudinal axis residing in the length dimension of said top surface, and a ½ "Tee" (½ T) shaped post residing parallel to said "Tee" (T) shaped post and adjacent to a top edge such that a complementary inverted "Tee" (T) shaped slot is formed therebetween said posts and a complementary inverted ½ "Tee" (½ T) shaped opening is formed adjacent to said "Tee" (T) shaped post; and wherein said longitudinal axis of each said rectangular plate resides perpendicular to said longitudinal axis of all rectangular plates with which it shares a single, common edge.

15. The construction set toy of claim 14 wherein said linear rail member has at least one exterior surface having a "Tee" (T) shaped post traversing the extent of said surface and residing parallel to, but offset from, a longitudinal axis of said surface, and a ½ "Tee" (½ T) shaped post residing parallel to said "Tee" (T) shaped post and adjacent to an edge such that a complementary inverted "Tee" (T) shaped slot is formed therebetween said posts and a complementary inverted ½ "Tee" (½ T) shaped opening is formed adjacent to said "Tee" (T) shaped post.

16. The construction set toy of claim 15 wherein said linear rail member has at least two exterior surfaces with said "Tee" (T) shaped post and said ½ "Tee" (½ T) shaped post residing thereon.

17. The construction set toy of claim 15 wherein said linear rail member has at least three exterior surfaces with said "Tee" (T) shaped post and said ½ "Tee" (½ T) shaped post residing thereon.

18. The construction set toy of claim 15 wherein said linear rail member has at least four exterior surfaces with said "Tee" (T) shaped post and said ½ "Tee" (½ T) shaped post residing thereon.

19. The construction set toy of claim 15 wherein said linear rail member has at least six exterior surfaces with said "Tee" (T) shaped post and said ½ "Tee" (½ T) shaped post residing thereon.

* * * * *